US006183295B1

(12) United States Patent
Hashimoto

(10) Patent No.: US 6,183,295 B1
(45) Date of Patent: Feb. 6, 2001

(54) MOUNTING FIXTURE FOR USE WITH AN ELECTRICAL CONNECTOR

(75) Inventor: Shinichi Hashimoto, Tokyo (JP)

(73) Assignee: The Whitaker Corporation, Wilmington, DE (US)

( * ) Notice: Under 35 U.S.C. 154(b), the term of this patent shall be extended for 0 days.

(21) Appl. No.: 09/289,593

(22) Filed: Apr. 9, 1999

(30) Foreign Application Priority Data

Apr. 15, 1998 (JP) ..... 10-104276

(51) Int. Cl.[7] ..... H01R 13/73
(52) U.S. Cl. ..... 439/573; 439/607
(58) Field of Search ..... 439/564, 571, 439/567, 569, 607, 573

(56) References Cited

U.S. PATENT DOCUMENTS 5,681,186 * 10/1997 Wright ..... 439/675
5,697,799 * 12/1997 Consoli et al. ..... 439/181
6,027,372 * 2/2000 Lai et al. ..... 439/573
6,050,852 * 4/2000 Wu ..... 439/607

FOREIGN PATENT DOCUMENTS 58-95578 6/1983 (JP) .

* cited by examiner

*Primary Examiner*—Neil Abrams
*Assistant Examiner*—Michael C. Zarroli

(57) ABSTRACT

A board-mounted electrical connector makes it possible to sufficiently reduce stress in the connector housing caused by threaded attachment fixtures. Metal fixtures (30) for mounting of the electrical connector to a circuit board are arranged in end sections (27) of a thin and long housing (20). The metal fixtures (30) are secured in oblong openings (72) provided in end portions (46) of a metal shield (40) attached to an outside surface of the housing (20) so that they cannot rotate inside the openings. The metal fixtures (30) are retained in the openings by means of integral resilient retaining members (71) of the shield (40) being disposed in grooves (36) in the metal fixtures (30).

8 Claims, 4 Drawing Sheets

MOUNTING FIXTURE FOR USE WITH AN ELECTRICAL CONNECTOR

FIELD OF THE INVENTION

The present invention relates to electrical connectors, especially to electrical connectors comprising metal fixtures to receive screws for attaching the connectors to a panel or to a circuit board.

BACKGROUND OF THE INVENTION

An example of an electrical connector of the type of an electrical connector relating to the present invention is disclosed in Japanese Patent Publication 58-95578 wherein the connector disclosed therein has metal fixtures located at both ends of the connector, the purpose of which is to attach the connector to a panel or circuit board. The metal fixtures receive screws, thus mounting the housing to the panel or circuit board.

Recent trends in the reduction in size of electrical connectors require reducing the connector height as well. Therefore, the portion of the housing that contains the metal fixtures must be made very thin. However, since the housing is made too thin, there is a danger that the housing may break due to the force of the tightened screws or due to their rotation.

Therefore, the purpose of the present invention is to provide an electrical connector wherein the stress applied to the housing during the attachment of the connector by means of threaded devices is sufficiently low, thus making it possible to make the electrical connector comparatively low in height.

SUMMARY OF THE INVENTION

The electrical connector of the present invention has a metal shield affixed to an outer surface of a dielectric housing, and metal fixtures comprising a threaded section for attachment of the connector to a circuit board and for the connection of the metal shield to a grounding bus of the circuit board, the metal fixtures are engaged with the metal shield so that the metal fixtures cannot rotate relative to the metal shield, and that the metal fixtures assure that one side of the housing engages with the metal shield and the other side of the housing engages with the circuit board when the connector is mounted thereon.

The metal fixtures include a guiding device intended for guiding the mating connector during the joining of the connectors.

The cross section of a portion of the metal fixtures is asymmetrical in the rotation direction and that the openings in the shield into which the metal fixtures are inserted have a configuration that complements the cross section.

The openings have spring-loaded retaining members fitting into grooves in the metal fixtures.

The housing is provided with through holes accommodating threaded retaining devices of the metal fixtures which have grooves into which the spring-loaded members can be accommodated.

BRIEF DESCRIPTION OF THE DRAWINGS

An embodiment of the present invention will now be described by way of example with reference to the accompanying drawings in which:

FIG. 1A is a top plan view; FIG. 1B is a side view.

FIGS. 2A is a cross section taken along line 2A—2A of FIG. 1B; FIG. 2B is a cross section taken along line 2B—2B of FIG. 1B.

FIG. 3A is a top plan view; FIG. 3B is a side view; FIG. 3C is a cross section taken along line 3C—3C of FIG. 3A.

FIG. 4A is a side view; FIG. 4B is a part cross-sectional view as viewed from the side; FIG. 4C is a bottom view.

DETAILED DESCRIPTION OF THE INVENTION

Figure 1A:
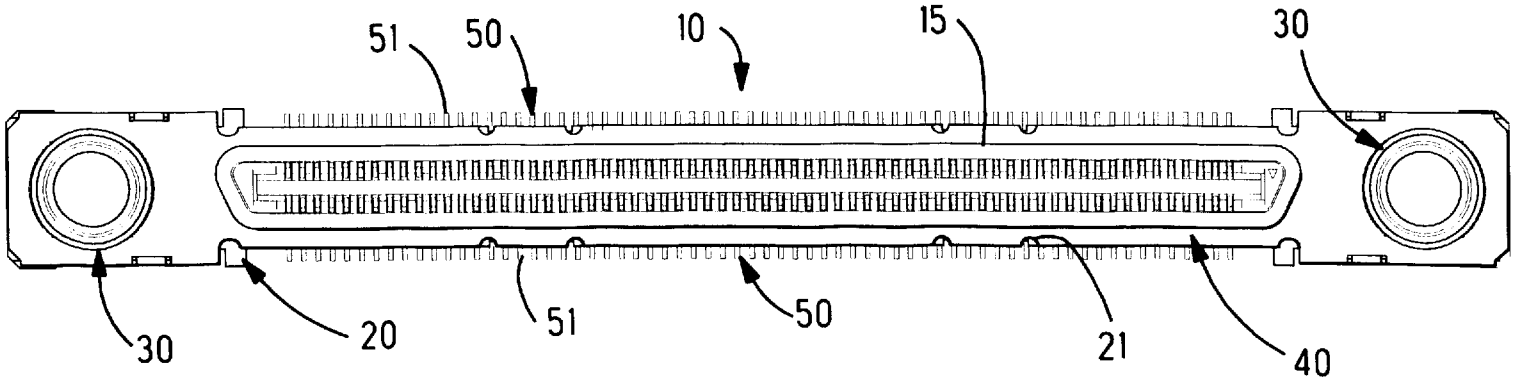
FIGS. 1A and 1B show a preferred embodiment of the electrical connector of the present invention.
Figure 1B:
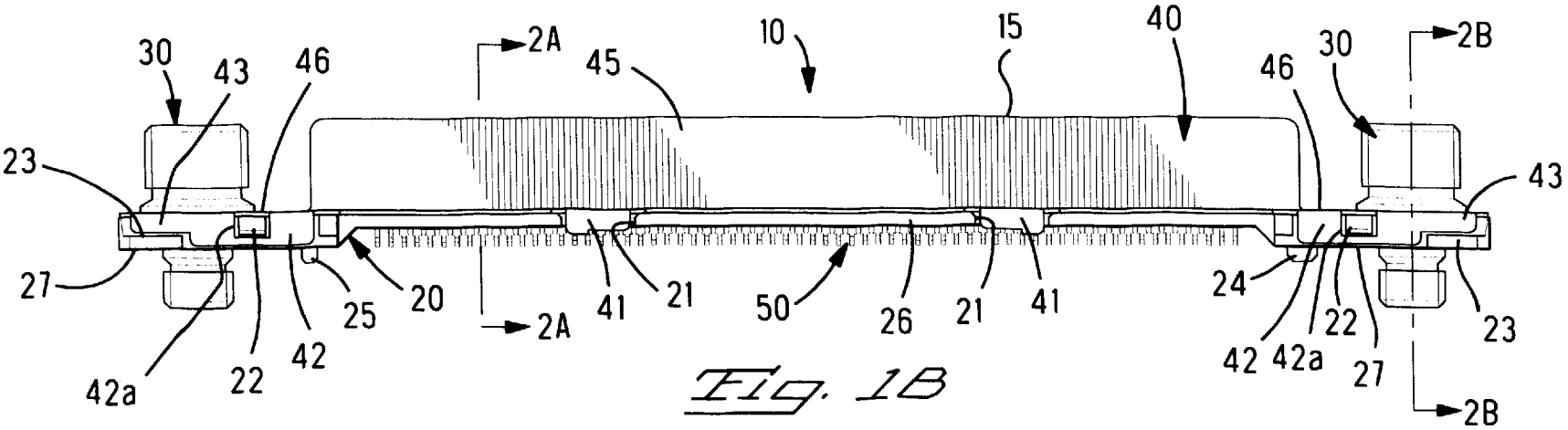

As can be seen from FIGS. 1A and 1B, the electrical connector 10 has a long and narrow configuration and comprises a dielectric housing 20, a metal shield 40 fitting over an outer surface of the housing 20, and multiple electrical contacts 50 having contact sections 50*a* (FIG. 2A) arranged inside the housing 20. The housing 20 and the shield 40 have a receptacle section 15, the purpose of which is to accommodate a mating connector. Termination sections 51 of the contacts 50 extend outside the housing for electrical connection to conductive areas on a circuit board. At both ends of the receptacle section 15 of the electrical connector 10, metal fixtures 30 are located. As explained below, the metal fixtures 30 are the means for attachment of the electrical connector 10 to a circuit board and also function as a grounding connection between the metal shield 40 and the circuit board as well as a guiding device for a mating connector (not shown).

The housing 20 has a main section 26 corresponding to the receptacle section 15 and end sections 27 in which the metal fixtures 30 are secured. At two locations near the bottom of the main section 26 at both sides thereof, vertically extending grooves 21 are located. Grooves 21 receive tabs 41 extending from a main portion 45 of the metal shield 40 and their purpose is the alignment of the metal shield 40 in the longitudinal direction relative to housing 20. The end sections 27 have lugs 22 and protrusions 23. The lugs 22 fit into openings 42*a* in first side walls 42 of end portions 46 of the metal shield 40, and their purpose is to secure the shield 40 on the housing 20. Protrusions 23 engage with second side walls 43 which are narrower than the first side walls 42, and their function is to align the end portions 46 of the shield 40 with the housing 20. The first and the second side walls 42, 43 protect the electrical connector 10 from penetration of foreign substances. In addition, on the bottom surface of the housing 20, near the boundaries of the main section 26 and the end sections 27, positioning posts 24, 25 of different diameters are located, the purpose of which is to properly align the connector during its mounting on the circuit board.

Figure 2A:
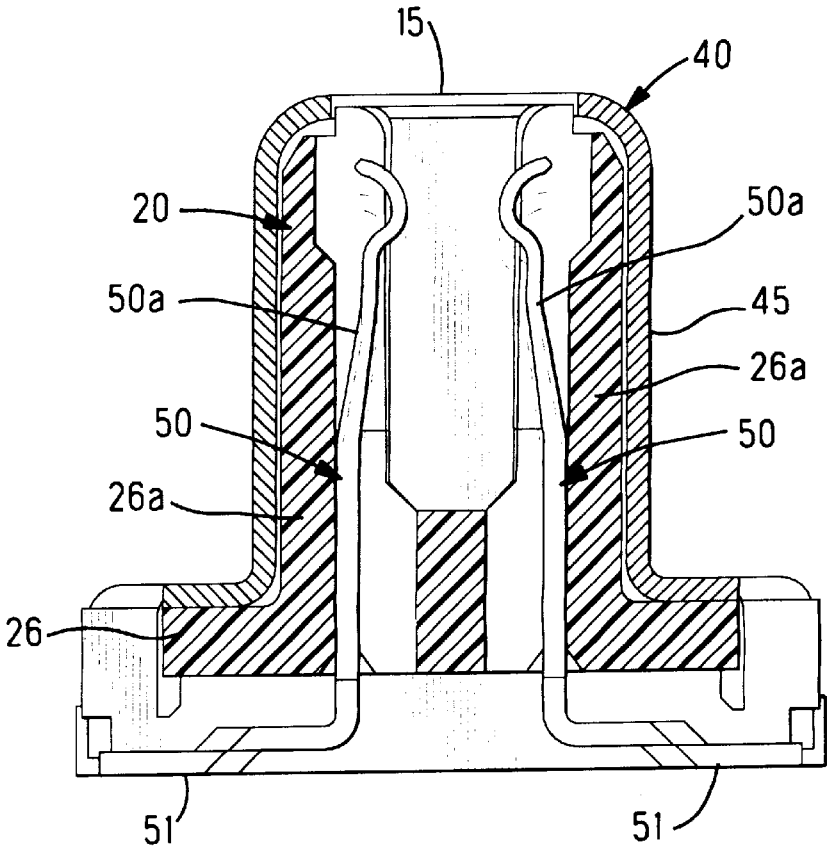
FIGS. 2A and 2B are cross-sectional views of the electrical connector shown in FIG. 1.
Figure 2B:
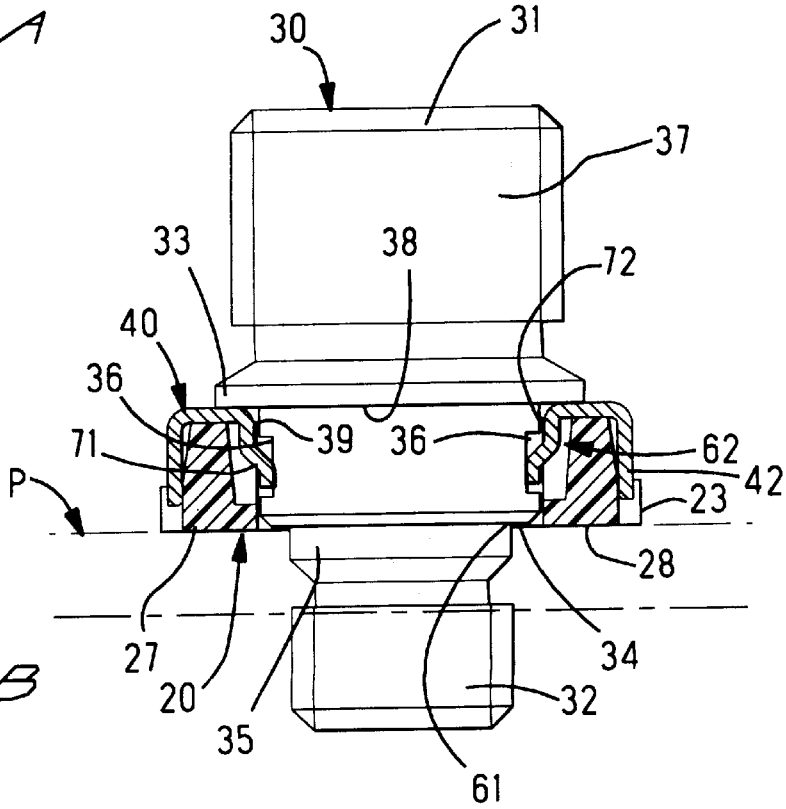

FIGS. 2A and 2B show more details for a better understanding of the configuration of the metal shield 40 and the housing 20. As can be seen from FIG. 2A, the main section 26 of the housing 20 has walls 26*a* extending upward, and the main portion 45 of the shield 40 also extends upward along the housing 20 and wraps around the receptacle section 15. As can be seen from FIG. 2B, the metal fixture 30 extends through hole 61 in the end section 27 of the housing 20 and it is retained therein by being engaged with the shield 40. This structure is explained in more detail hereafter.

Figure 3A:
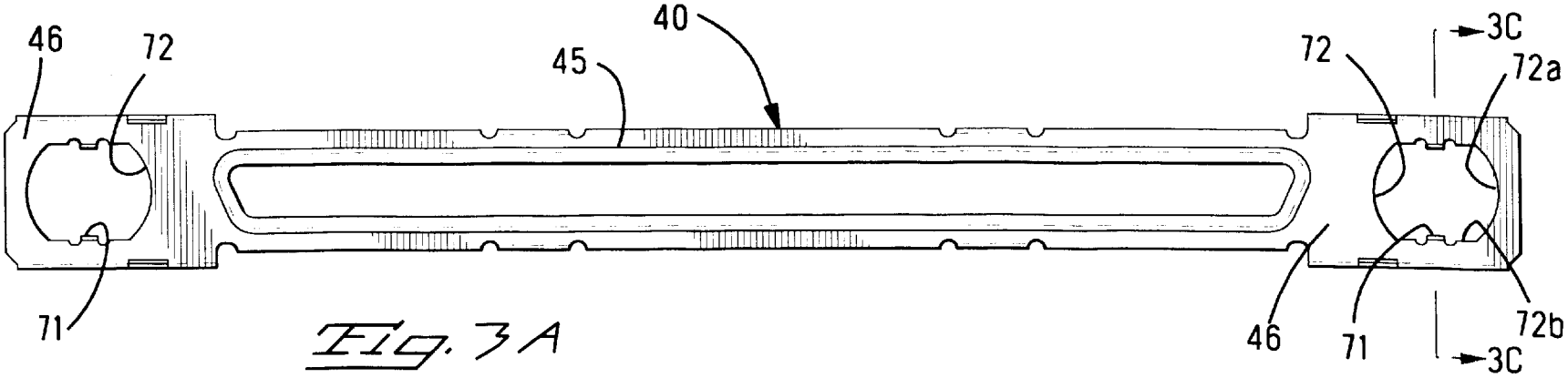
FIGS. 3A–3C show a metal shield.
Figure 3B:
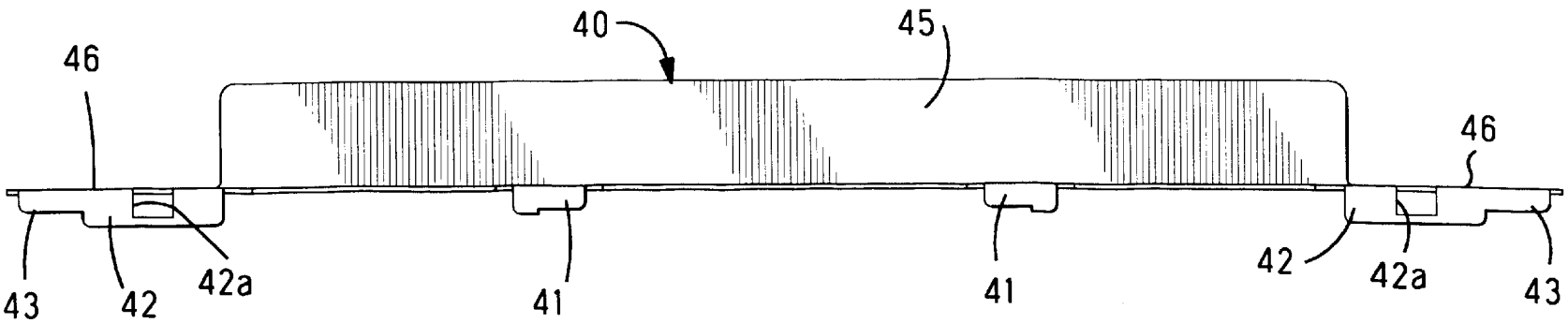
Figure 3C:
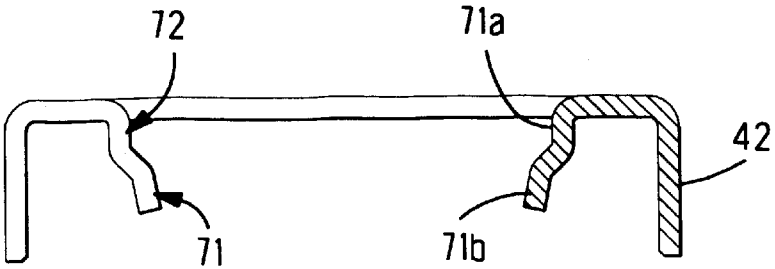

As can be seen from FIGS. 3A–3C, in the end portions 46 of the shield 40, non-symmetrical oblong openings 72 are located. The openings 72 have curved end surfaces 72*a* connected by straight side surfaces 72*b*. Curved end surfaces 72*a* and straight side surfaces 72*b* are arranged in pairs opposite to each other. In the center of each straight side surface 72*b,* resilient retaining members 71 extend downward. Each retaining member 71 has a vertical portion 71*a* extending down and a bent portion 71*b* protruding inside the opening 72.

Figure 4A:
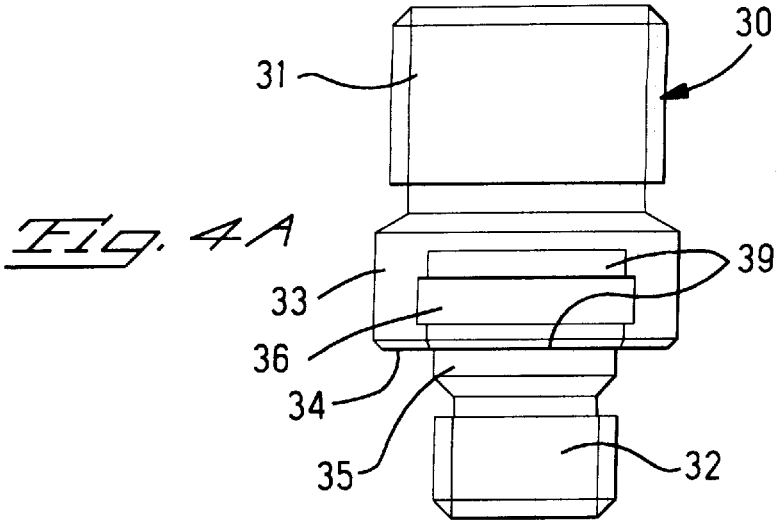
FIGS. 4A–4C show a metal fixture.
Figure 4B:
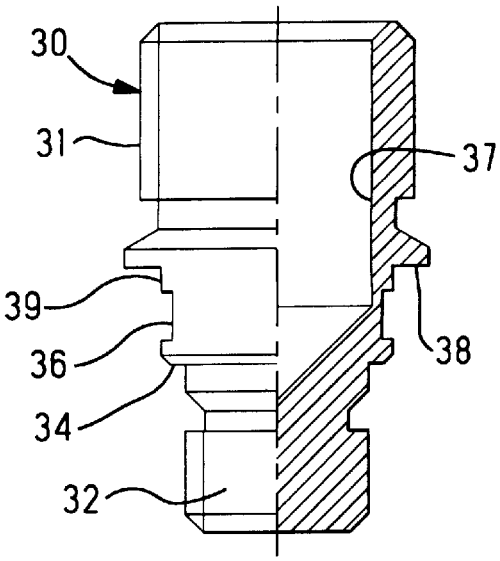
Figure 4C:
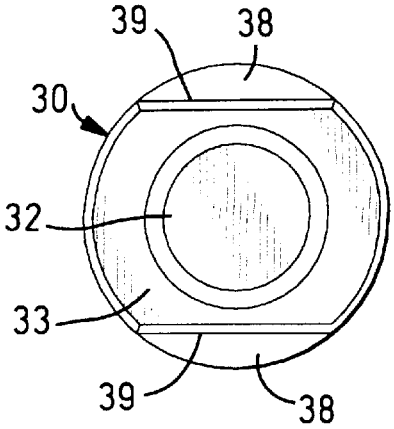

FIGS. 4A–4C represent more-detailed views of the metal fixture 30. The metal fixture 30 comprises a base section 33 located approximately in the center thereof, a head section 31 located above the base section 33 and a threaded section 32 located below the base section 33. FIG. 4B depicts an opening 37 extending through the head section 31 and the base section 33. The openings 37 accommodate alignment posts of the mating connector, thus properly aligning connectors when they are joined together. The threaded section 32 extends down from a pedestal 35 located directly under the base section 33. Parts of the surface of the base section 33 are cut off to form flat facets 39, thus demarcating a surface 38 facing downward. In addition, grooves 36 having a practically rectangular cross section are located in the facets 39.

As can be seen from FIG. 2B, during assembly of the connector, the shield 40 is placed so that the oblong openings 72 are aligned with the holes 61 of the housing 20. Thereafter, the metal fixtures 30 are inserted in the shield 40 placed over the housing 20 so that the facets 39 of the base sections 33 are aligned with the straight side surfaces 72*b* of the openings 72 (see FIGS. 3 and 4). During this step, the resilient retaining members 71 are first pressed in an outer direction and then they snap into the grooves 36, thus securing the metal fixtures 30 in the oblong openings 72. It should be noted that since the facets 39 and the straight side surfaces 72*b* extend along each other, the metal fixtures 30 are prevented from rotation in the openings 72. In addition, since the facets 39 and the straight sections 72*b* are engaged, the facets 39 become engaged also with the holes 61 of the housing 20. In the position in which the metal fixture 30 is retained, the bottom surface 34 of the base section 33 is either in the same plane as a bottom surface 28 of the end section 27 of the housing 20 or slightly higher. The surface 38 is approximately at the same level as an upper surface of the shield 40.

An important feature offered by the electrical connector 10 of the present invention, i.e. during the installation of the electrical connector 10 on a circuit board P (see FIGS. 2B), an upper surface of the board P is arranged along the bottom surface 28 of the housing 20, and the threaded sections 32 extend below a bottom surface of the board P and have nuts mounted thereon (not shown). When the nuts are tightened, the metal fixtures 30 remain in the fixed position due to the engagement of the facets 39 with the straight surfaces 72*b* and the holes 61 of the housing 20 and they are not subject to rotation. The major part of the stress generated by the tightening is transferred through the straight surfaces 72*b* to the shield and absorbed therein. During the tightening of the nuts, the surface 34 of the base section 33 engages with the board P. Therefore, no excessive stress is applied to the end sections 27 of the housing 20 even if the nuts are overtightened. As a result, in the process of securing the electrical connector 10 to board P, stress generated by nut rotation or by pressure caused by nuts overtightening is not transferred to the housing 20, thus making it possible to reliably attach the electrical connector 10 to the circuit board.

Explanations concerning the preferred embodiment of the electrical connector according to this invention have been provided; however, the present invention is not limited to this specific example, and various modifications may be made by experts in the field. As an example of such modifications, it is possible to change configuration and dimensions of the opening 72 so that the stress produced by the tightening of nuts is absorbed entirely by the shield 40.

The electrical connector according to the present invention has metal fixtures that are prevented from rotation relative to the shield as well as by the fact that the metal fixtures have one side of the housing in engagement with the shield and the other side of the housing engages with the circuit board when the connector is secured by nuts on the circuit board. This structure makes it possible to protect the housing from stresses caused by rotation of the nuts or by overtightening the nuts, thereby improving the certainty and reliability of the connector mounting onto the circuit board. In addition, this structure makes it possible to reduce the thickness of the housing and the overall height of the connector.

What is claimed is:

1. An electrical connector comprising a dielectric housing having electrical contacts secured therein;

a metal shield affixed to an outer surface of the dielectric housing;

end sections provided by the dielectric housing and having holes extending therethrough;

end portions of the metal shield extending over the end sections of the dielectric housing and having openings in alignment with the holes;

metal fixtures having base sections disposed in the aligned openings and holes; and retaining members provided by the end portions, the retaining members are resilient, whereby the retaining members resiliently engage the metal fixtures to retain the metal fixtures in position relative to the metal shield.

2. An electrical connector as claimed in claim 1, wherein the openings are oblong openings having opposed flat surfaces and opposed curved surfaces.

3. An electrical connector as claimed in claim 2, wherein the base sections include head sections extending upwardly therefrom and threaded sections extending downwardly therefrom.

4. An electrical connector as claimed in claim 2, wherein the base sections have flat facets in engagement with the flat surfaces and demarcating a surface in engagement with the end portions of the metal shield.

5. An electrical connector as claimed in claim 4, wherein the flat facets have grooves disposed therein.

6. An electrical connector as claimed in claim 5, wherein the resilient retaining members extend from the opposed flat surfaces and are disposed within the grooves.

7. An electrical connector as claimed in claim 4, wherein bottom surfaces of the base sections are in the same plane as the bottom surfaces of the end sections of the dielectric housing.

8. An electrical connector as claimed in claim 1, wherein the metal fixtures have through holes therethrough.

* * * * *